US008165331B2

(12) United States Patent
Beyfuβ et al.

(10) Patent No.: US 8,165,331 B2
(45) Date of Patent: Apr. 24, 2012

(54) HEARING APPARATUS WITH VARIABLY MOUNTED CONTROL ELEMENT

(75) Inventors: Stefanie Beyfuβ, Erlangen (DE); Holger Kral, Fürth (DE); Michael Sattler, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 829 days.

(21) Appl. No.: 12/283,923

(22) Filed: Sep. 16, 2008

(65) Prior Publication Data

US 2009/0080680 A1 Mar. 26, 2009

(30) Foreign Application Priority Data

Sep. 24, 2007 (DE) ..... 10 2007 045 460

(51) Int. Cl.
*H04R 25/00* (2006.01)

(52) U.S. Cl. ..... 381/324; 381/321; 381/23.1; 381/312; 381/314; 341/34

(58) Field of Classification Search ..... 381/312, 381/322, 324, 327, 328, 330
See application file for complete search history.

(56) References Cited

U.S. PATENT DOCUMENTS

| | | | | |
|---|---|---|---|---|
| 4,598,177 | A | 7/1986 | McGroarty et al. | |
| 5,204,917 | A * | 4/1993 | Arndt et al. | 381/324 |
| 5,463,692 | A * | 10/1995 | Fackler | 381/324 |
| 7,515,726 | B2 * | 4/2009 | Portmann | 381/324 |
| 2005/0041826 | A1 * | 2/2005 | Dittli | 381/322 |
| 2008/0031475 | A1 * | 2/2008 | Goldstein | 381/151 |

FOREIGN PATENT DOCUMENTS

DE 10 2005 037 897 B3 4/2007

* cited by examiner

*Primary Examiner* — Steven Loke
*Assistant Examiner* — David Goodwin

(57) ABSTRACT

A hearing apparatus is provided with a housing including a first housing mounting element and a control element that is mounted rotatably in the first housing mounting element via a control mounting element. Furthermore the housing has at least one second housing mounting element so that the control element can be optionally mounted rotatably in the first housing mounting element or in the second housing mounting element. Thus the control element can be actuated in a desired position.

13 Claims, 2 Drawing Sheets

HEARING APPARATUS WITH VARIABLY MOUNTED CONTROL ELEMENT

CROSS REFERENCE TO RELATED APPLICATIONS

This application claims priority of German application No. 10 2007 045 460.2 DE filed Sep. 24, 2007, which is incorporated by reference herein in its entirety.

FIELD OF INVENTION

The present invention relates to a hearing apparatus with a housing including a housing mounting element and a control element that is mounted rotatably in the housing mounting element by means of a control mounting element. The term "hearing apparatus" is understood here to mean in particular a hearing device, but also any other sound-emitting device that can be worn in or on the ear such as a headset, a set of ear phones and the like.

BACKGROUND OF INVENTION

Hearing devices are wearable hearing apparatuses which are used to assist the hard-of-hearing. In order to accommodate numerous individual requirements, various types of hearing devices are available such as behind-the-ear (BTE) hearing devices, hearing device with external receiver (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

SUMMARY OF INVENTION

Control elements in hearing devices are generally arranged centrally. In the case of a button these control elements are then actuated vertically. Irrespective of the shape and size of the respective control element, many users find it difficult to press a button vertically in this way. From an ergonomic perspective, pressing a button transversely from the side is considerably more advantageous.

However if control elements that can be operated laterally and/or transversely are built into hearing devices, then different control elements and/or different hearing devices are to be provided for the left and right side. This results in increased manufacturing and logistics costs, which it would be expedient to avoid.

The object of the present invention is thus to provide a hearing apparatus that is ergonomically easy to operate, whereby the manufacturing and logistics costs are reduced in comparison to conventional realizations.

This object is achieved in accordance with the invention by means of a hearing apparatus with a housing including a first housing mounting element and a control element that is mounted rotatably in the first housing mounting element by means of a control mounting element, with the housing having at least one second housing mounting element so that the control element can be optionally mounted rotatably in the first housing mounting element or in the second housing mounting element.

The plurality of options for mounting the control element on the housing advantageously ensures a considerably greater level of operating convenience without there being a need to use different devices for the left and right side. Furthermore the option of mounting at various points automatically results in the interchangeability of the control element, which can be employed especially advantageously for a colored exchangeable-shell concept.

The hearing apparatus preferably has a button that can be operated with the control element. An on/off switching function or a program selection function for example can be realized with a button of this kind.

Furthermore the control element can have an essentially disk-shaped main body, the control mounting element located near a front side of the main body, and a control button protruding essentially perpendicularly from the disk-shaped main body in the vicinity of the opposite front side of the main body. This opposition between the control button and mounting allows a button to be actuated by transversely pressing on the control element without slipping off the main body.

The control mounting element can additionally be coupled to the housing mounting element by means of a removable snap-on connection. This snap-on connection makes the interchangeability of the control element and/or the replacement of the mounting position of the control element considerably simpler.

According to a preferred embodiment of the present invention the hearing apparatus is embodied as an ITE hearing device with a housing faceplate, with the housing mounting elements in turn being part of the housing faceplate. Thus the ergonomic operating concept according to the invention can be used in particular for the small ITE hearing devices that frequently have a housing faceplate of this type. Of course the control element can also be mounted on another part of the housing of a hearing device.

BRIEF DESCRIPTION OF THE DRAWINGS

The present invention is described in more detail with reference to the appended drawings, in which.

DETAILED DESCRIPTION OF INVENTION

The exemplary embodiment shown in more detail below represents a preferred embodiment of the present invention.

Figure 1:
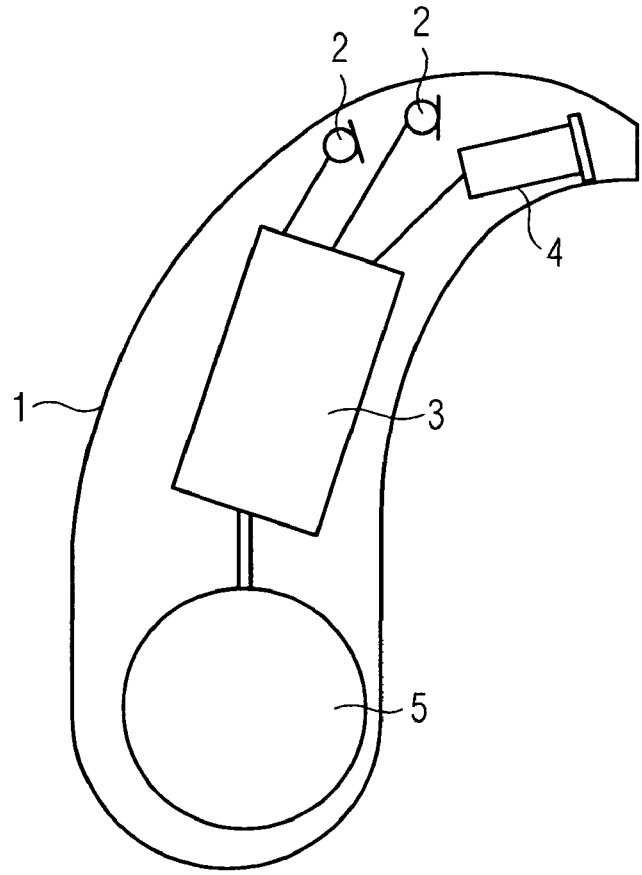
FIG 1 (Prior art)
FIG. 1 shows the basic design of a hearing device according to the prior art.
Figure 2:
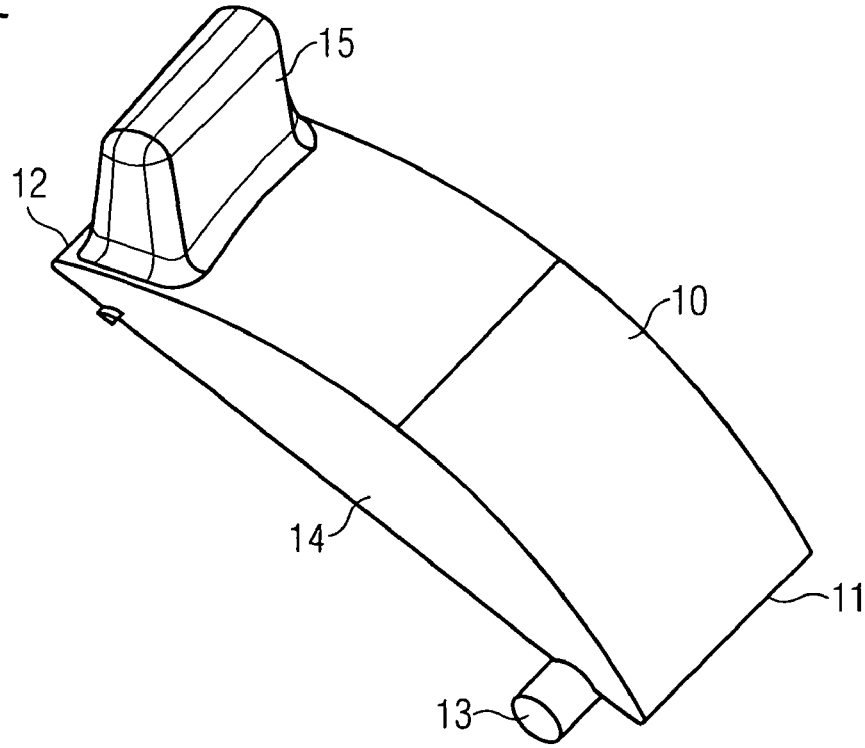
FIG. 2 shows a perspective view of a control element according to the invention.

The example of a control element illustrated in FIG. 2 serves to actuate a button (not shown) and consists of an essentially disk-shaped main body 10. In the present example the main body is slightly curved on the surface and is thus adapted for example to the surface of a housing faceplate (compare FIGS. 4 and 5). In addition the main body 10 is embodied here as an oblong. This accordingly results in the two longitudinal front sides 11 and 12. On the underside of the main body 10 near the first longitudinal front side 11 a cylinder-shaped axial element 13 is arranged in parallel to this front side 11 as a control mounting element. The axial element 13 protrudes here slightly from the transverse side 14 of the main body 10 but also from the underside of the main body 10. With its longitudinal axis it also runs in parallel to the longitudinal front side 11 of the main body 10.

A cuboidal or wedge-shaped control button 15 with rounded corners and edges protrudes perpendicularly from the surface of the main body 10 in the vicinity of the opposite longitudinal front side 12 of the main body 10.

Figure 3:
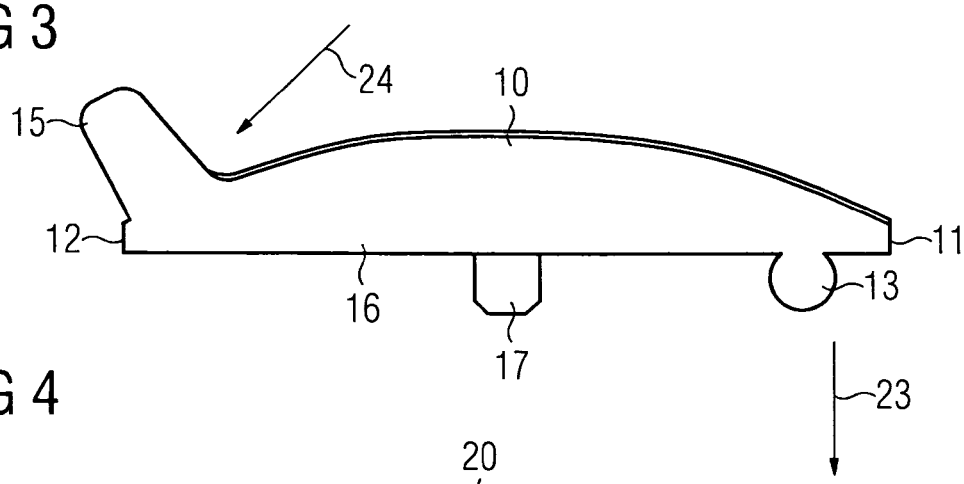
FIG. 3 shows a lateral view of the control element shown in FIG. 2.

FIG. 3 reproduces a lateral view of the control element shown in FIG. 2. It can be seen that the control button 15 assumes an approximately 60° angle relative to the underside 16 of the main body 10. The axial element 13 can also be seen on the opposite side. FIG. 3 additionally shows a pin 17 that protrudes perpendicularly downward from the underside 16 and serves to conduct the force exerted on the control element to a button. The control element shown in FIG. 3 with all its components 13, 15 and 17 can be made as a one-piece die-cast component. In particular it can be cast with different colors.

Figure 4:
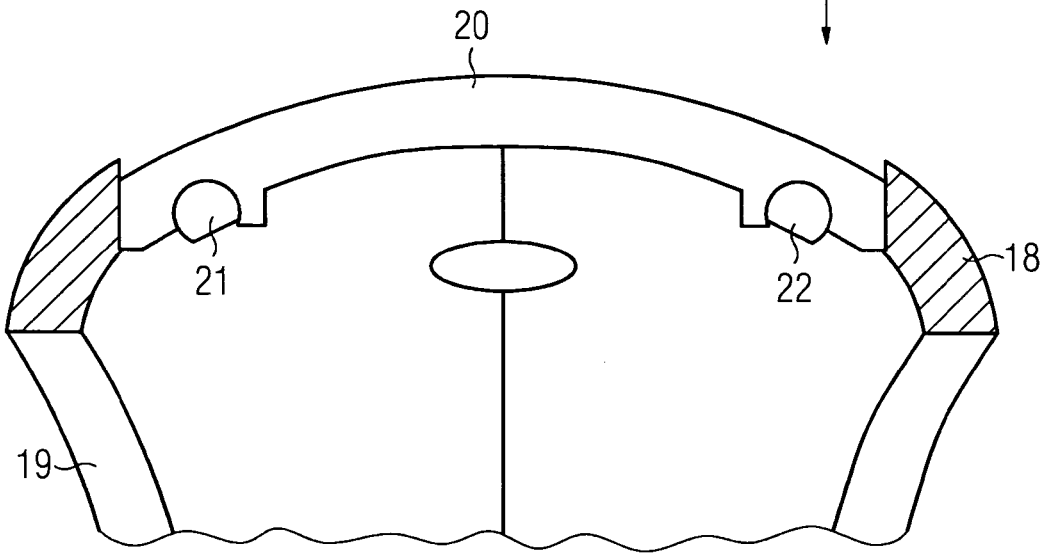
FIG. 4 shows a cross-section through a hearing device housing into which the control element shown in FIG. 3 is to be inserted.

FIG. 4 shows a cross-section through an ITE hearing device having a housing faceplate 18 and a subjacent shell 19 that is generally adjusted to an auditory canal. A recess 20 is provided in the housing faceplate 18 into which the control element of FIG. 3 can be inserted. Furthermore a first housing mounting element 21 and a second housing mounting element 22 are provided in or on the recess 20 of the housing shell 18. In the present example the housing mounting elements 21 and 22 are realized as rounded recesses in the housing shell 18. The axial element 13 can be snapped into these recesses. According to the arrow 23 the control element of FIG. 3 is mounted on the right housing mounting element 22. Consequently the built-in control element (push button cover) represents a left button element since, relative to the follower pin 17, its control button 15 is located on the opposite side of the control mounting element and/or axial element 13 located on the right.

Owing to the transverse positioning of the control button 15 and the special position opposite the axial element 13, the control element can be operated most effectively with a force at the location of and in the direction of the arrow 24 shown in FIG. 3. The control element can accordingly be actuated transversely to the main body 10 and thus ergonomically advantageously.

Figure 5:
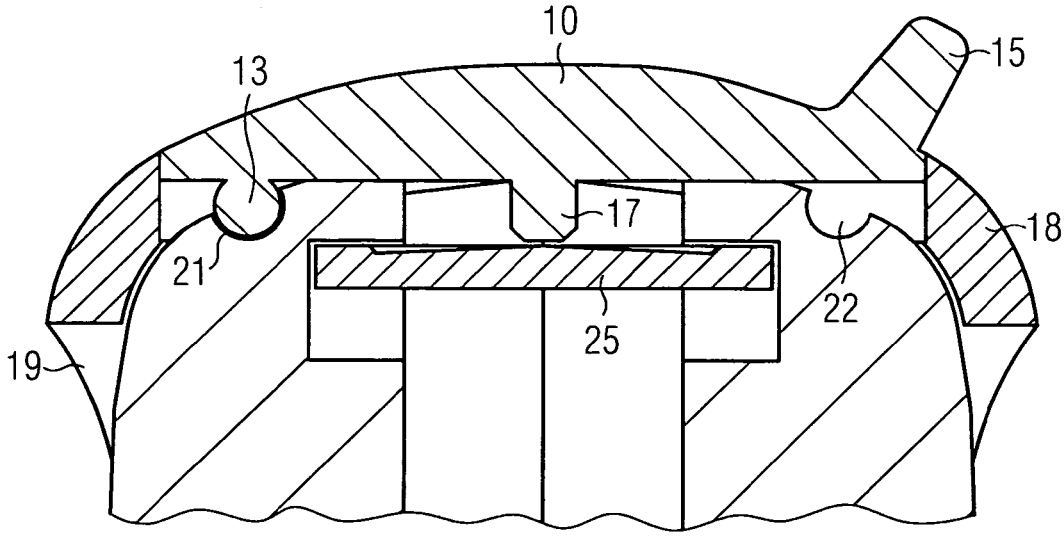
FIG. 5 shows a section through the hearing device according to FIG. 4, but in which the control element is inserted in the other direction.

Finally FIG. 5 shows the control element that is built into and/or snapped into the housing faceplate 18. However the control element is not built into the right housing mounting element 22 but is instead rotatably built with its axial element 13 into the left housing mounting element 21. Consequently the control button 15 is now located on the right side in respect of the Figure, which is why the control element can be referred to as the "right control element".

An electronic button 25 is additionally shown in FIG. 5, on which the follower pin 17 presses when the control element is actuated. The control element is reset either by the button 25 or by a separate spring (not shown) that is affixed for example to the housing faceplate 18.

Overall therefore a laterally-operable button is provided on the hearing device, the control element (push button cover) of which can also be rotated through 180° and inserted into the housing of the hearing apparatus. If for example the control element is square-shaped, and if the housing has a housing mounting element on all sides of a square opening in the housing, the control element can also be rotated in four different directions before insertion. Operating convenience may possibly be increased further as a result. Thus for example a triangular shape is also conceivable, as are any other polygonal shapes or indeed other shapes of the control element, such that the angle of operation can be as ergonomic as possible in design.

The force is conducted from the control element to the electronic switch centrally via the pin 17 to the underside 16 of the main body 10. The symmetrical/central insertion of the switch 25 in the housing 18, 19 obviates the need for left or right housing/frame modules. Different control elements and/or realizations of covers with a selectable size of control button may possibly be provided so that e.g. a small, inconspicuous control element or a large, conspicuous control element can be provided according to the corresponding user group.

The invention claimed is:

1. A hearing apparatus, comprising:

a housing having a first housing mounting element and a second housing mounting element, wherein the first and second housing mounting elements are located at opposite ends of each other; and a control element having a control mounting element and a control button located at first and second ends, respectively, of the control element, wherein the control element is rotatably mounted to the housing via the control mounting element and either the first housing mounting element to form a first pivot arrangement located opposite the control button to enable transverse actuation of the control button in a first direction or the second housing mounting element to form a second pivot arrangement located opposite the control button to enable transverse actuation of the control button in a second direction opposite the first direction to thereby form a reversible control element mounting arrangement.

2. The hearing apparatus as claimed in claim 1, further comprises a an electronic button that is operated with the control element.

3. The hearing apparatus as claimed in claim 1, wherein the control element includes an essentially disk-shaped main body, wherein the control mounting element is located near a front side of a main body of the housing, and wherein the control button protrudes essentially perpendicularly from the disk-shaped main body in the vicinity of an opposite front side of the main body.

4. The hearing apparatus as claimed in claim 1, wherein the control mounting element is mounted to the housing by a removable snap-on connection.

5. The hearing apparatus as claimed in claim 1, wherein the control mounting element is mounted to the housing via by a snap-on connection.

6. The hearing apparatus as claimed in claim 1, wherein the hearing apparatus is embodied as an in the ear hearing device with a housing faceplate, and the first and second housing mounting elements are part of the housing faceplate.

7. A hearing apparatus, comprising: a housing having a first housing mounting element and a second housing mounting element, the housing mounting elements located opposite of each other on a generally symmetrically part of the housing; and a control element having a control mounting element at or in a vicinity of a first end of the control element and a control button at a second end of the control element for actuating the control element, wherein the control element is rotatably mounted to the housing via the control mounting element and the first housing mounting element to form a first pivot arrangement located opposite the control button to enable transverse actuation of the control button in a first direction, and wherein the control element is rotatably mountable by mounting the control element to the housing via the control mounting element and the second housing mounting element to form a second pivot arrangement located opposite the control button to enable transverse actuation of the control button in a second direction opposite the first direction to thereby form a reversible control element mounting arrangement.

8. The hearing apparatus as claimed in claim 7, further comprises an electronic button, wherein the control element comprises a protruding element in order to actuate the electronic button via a movement of the control element.

9. The hearing apparatus as claimed in claim 8, wherein the electronic button is located generally centered between the first and second housing mounting elements.

10. The hearing apparatus as claimed in claim 8, wherein the protruding element is located on the same side of the control element as the control mounting element.

11. The hearing apparatus as claimed in claim 8, wherein the electronic button is located within the housing.

12. A hearing apparatus having an electronic button, comprising:

a housing having a first housing mounting element and a second housing mounting element, the housing mounting elements located opposite of each other on a generally symmetrically part of the housing; and a control element having, first and second ends:

a control mounting element located at the first end and a control button located at the second end, and a protruding element, wherein the control element is rotatably mounted to the housing via the control mounting element and either the first housing mounting element to form a first pivot arrangement located opposite the control button to enable transverse actuation of the control button in a first direction or the second housing mounting element to form a second pivot arrangement located opposite the control button to enable transverse actuation of the control button in a second direction opposite the first direction to thereby form a reversible control element mounting arrangement, and wherein the protruding element actuates an electronic button via a movement of the control button.

13. The hearing apparatus as claimed in claim 12, wherein the electronic button is located within the housing.

* * * * *